US009478853B2

(12) United States Patent
Raum et al.

(10) Patent No.: US 9,478,853 B2
(45) Date of Patent: Oct. 25, 2016

(54) ANTENNA STRUCTURE FOR THE WIDE-BAND TRANSMISSION OF ELECTRICAL SIGNALS

(71) Applicant: GAT Gesellschaft fur Antriebstechnik mbH, Geisenheim (DE)

(72) Inventors: Robert Raum, Geisenheim (DE); Harry Schilling, Schwabach (DE)

(73) Assignee: GAT Gesellschaft Fur Antriebstechnik mbH, Geisenheim (DE)

( * ) Notice: Subject to any disclaimer, the term of this patent is extended or adjusted under 35 U.S.C. 154(b) by 17 days.

(21) Appl. No.: 14/441,439

(22) PCT Filed: Nov. 13, 2013

(86) PCT No.: PCT/EP2013/073680

§ 371 (c)(1),
(2) Date: May 7, 2015

(87) PCT Pub. No.: WO2014/079744

PCT Pub. Date: May 30, 2014

(65) Prior Publication Data

US 2015/0270607 A1 Sep. 24, 2015

(30) Foreign Application Priority Data

Nov. 23, 2012 (DE) ..... 10 2012 111 382

(51) Int. Cl.
*H01Q 1/38* (2006.01)
*H01Q 1/50* (2006.01)
(Continued)

(52) U.S. Cl.
CPC *H01Q 1/50* (2013.01); *H01P 5/04* (2013.01); *H01Q 13/206* (2013.01)

(58) Field of Classification Search
CPC ..... H01P 5/04; H01Q 13/206; H01Q 1/50
USPC ..... 343/700 MS, 702, 829, 846, 850, 853; 324/318, 322
See application file for complete search history.

(56) References Cited

U.S. PATENT DOCUMENTS 5,287,117 A 2/1994 Posluszny
5,327,148 A * 7/1994 How ..... H01Q 3/44 343/700 MS (Continued)

FOREIGN PATENT DOCUMENTS

DE 44 12 958 A1 10/1995
EP 1 476 956 B1 6/2006
WO 98/29919 A1 7/1998

OTHER PUBLICATIONS

Agnes Wittmann-Regis, International Preliminary Report on Patentability, PCT/EP2013/073680, World Intellectual Property Organization, May 28, 2015.

*Primary Examiner* — Tho G Phan
(74) *Attorney, Agent, or Firm* — Paul & Paul

(57) ABSTRACT

The invention relates to an antenna structure for the wide-band transmission of electrical signals, which has a stripline and a probe that can be capacitively or inductively coupled to the stripline, wherein the stripline and the probe are arranged so as to be movable in relation to each other within a specified distance range between the probe and the stripline in the longitudinal direction of the stripline such that electrical signals can be transmitted between the stripline and the probe without contact, wherein the stripline comprises at least one strip electrode facing the probe, a reference electrode, and a dielectric carrier material located between the strip electrode and the reference electrode. In order to provide a wide-band and economical device for signal transmission that has a conductor structure that achieves high symmetry of the signal and low attenuation values even at high frequencies, the dielectric carrier material comprises, according to the invention, a homogeneous plastic layer containing macromolecules, said plastic layer being characterized by an orientation of the macromolecules along a preferred direction.

16 Claims, 2 Drawing Sheets

Figure 1:
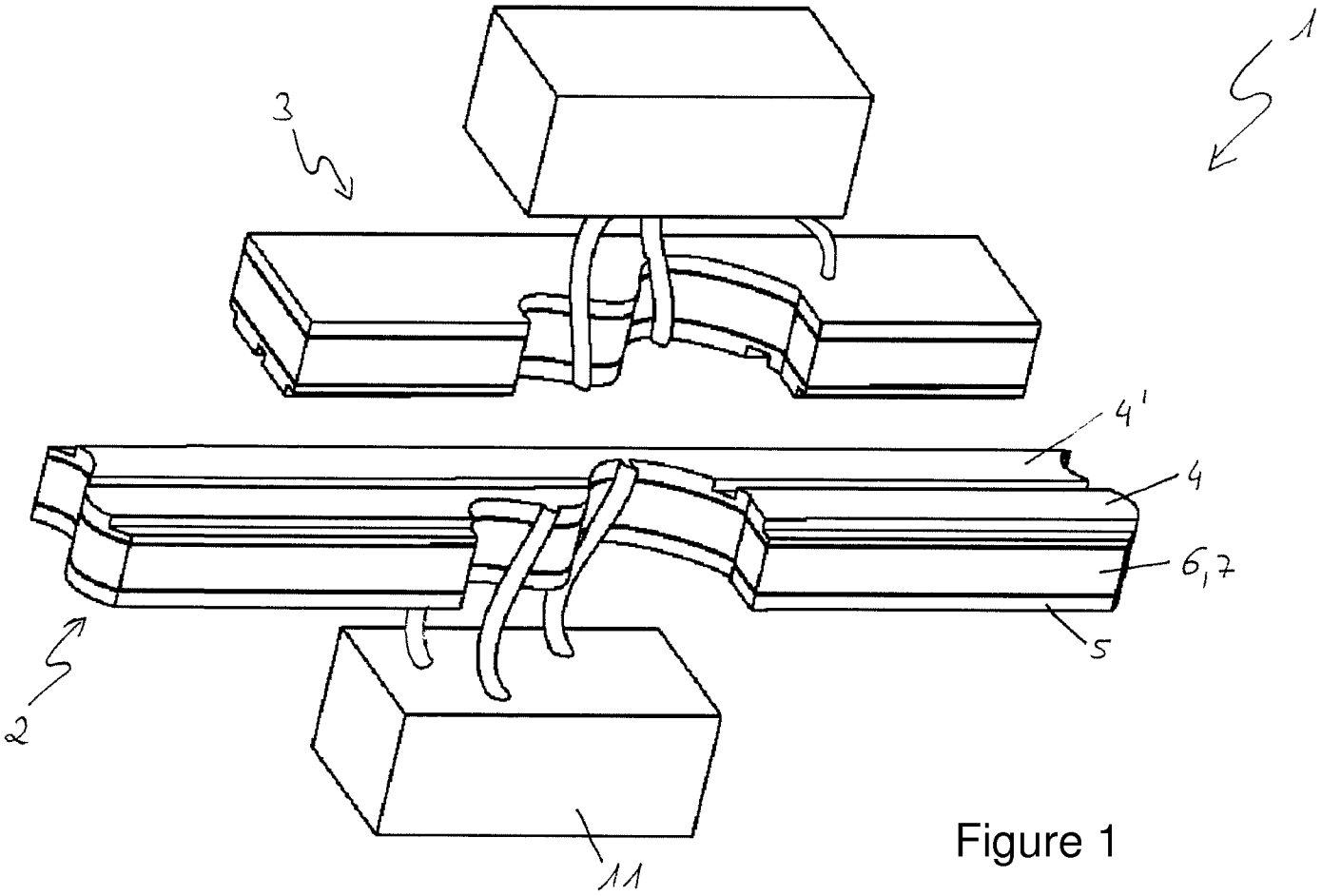

(51) Int. Cl.
*H01P 5/04* (2006.01)
*H01Q 13/20* (2006.01)

(56) References Cited

U.S. PATENT DOCUMENTS 5,337,065 A * 8/1994 Bonnet ..... H01Q 21/0081 343/700 MS
5,442,367 A * 8/1995 Naito ..... H01Q 21/0081 343/700 MS
6,356,245 B2 * 3/2002 Metzen ..... H01P 3/085 343/700 MS
7,324,059 B2 * 1/2008 Lee ..... H01Q 1/38 343/700 MS
7,518,554 B2 * 4/2009 Bateman ..... H01Q 1/38 343/700 MS
2005/0040917 A1 2/2005 Schilling

* cited by examiner

ANTENNA STRUCTURE FOR THE WIDE-BAND TRANSMISSION OF ELECTRICAL SIGNALS

CROSS-REFERENCE TO RELATED APPLICATION

This is a national stage 371 application of International Application No. PCT/EP2013/073680 filed Nov. 13, 2013.

The present invention concerns an antenna structure for the wide-band transmission of electrical signals, which has a stripline and a probe which can be capacitively or inductively coupled to the stripline, wherein the stripline and the probe are arranged movably relative to each other in the longitudinal direction of the stripline within a predetermined spacing range between the probe and the stripline so that electrical signals can be contact-lessly transmitted between the stripline and the probe, wherein the stripline includes at least one strip electrode facing the probe and a reference electrode and a dielectric carrier material between the strip electrode and the reference electrode.

Such an antenna structure is known from EP 1 476 956 B1.

If electrical signals are to be transmitted between two components which are movable relative to each other, as is necessary for example in regard to crane or conveyor installations, radar installations or computer tomographs, the attempt is made for obvious reasons to dispense with movement-limiting cable connections. An apparatus suitable for that purpose is described in DE 44 12 958. Here the signal to be transmitted is fed into a stripline of the first unit which is arranged along the path of movement of the mutually movable units. The signal is taken off from the second unit by means of capacitive or inductive coupling.

An improved apparatus for transmission purposes, as is described for example in WO 98/29919, is based on a special line conductor structure which at the same time has filter properties.

In the specification hereinafter the term 'stripline' refers to all forms of conductor line structures whose longitudinal extent is greater than their extent perpendicularly to the longitudinal axis and which are suitable for carrying electrical signals. The signals are coupled out in the near field of the stripline, wherein signal coupling-out in the ideal situation is to be effected exclusively in the region of the second unit. More extensive signal emission is undesirable as the wide-band signals can lead to disturbances and interference in other items of equipment or apparatus parts.

The striplines used for transmission purposes are generally constructed based on double-sided circuit boards. In general a glass fiber-reinforced plastic serves as the dielectric carrier material. That carrier is generally provided on one side with a continuous conductor surface as a reference electrode and on the other side with a strip electrode.

One of the severest technical problems with such antenna structures is the attainment of high interference immunity as well as signal transmission restricted to a varying receiving region, that is to say a low level of overall radiation along the entire stripline.

One solution which avoids those problems is set out in U.S. Pat. No. 5,287,117. Therein the line arrangement is replaced by a plurality of small antenna segments. They can be produced on circuit boards of small area using high-value materials. It will be noted however that here too the high number of antenna segments involves a high level of material implementation and in particular a high degree of assembly complication, leading to high manufacturing costs.

EP 1 476 956 describes line arrangements using at least one dielectric with hollow structures, the hollow structures being filled with air or a technical gas. A disadvantage here, besides the high level of complication and expenditure for producing and filling the hollow structures and the high costs linked thereto, is in particular the fluctuations occurring in homogeneity as the hollow space intermediate walls and the air or technical gas do not have the same dielectric constant.

Therefore the it is necessary design antenna structures in particular in such a way that during wide-band transmission of electrical signals, unintended interactions with neighboring electric and electronic devices are avoided and a good transmission quality is provided.

The invention described in EP 1 476 956 B1, in this context aims at an as large as possibly symmetry of the dielectric on both sides of an electrical conductor and achieves this through use of a foamed polyethylene material with high homogeneity and high symmetry with respect to the electric center of the longitudinal axis of the conductor line, wherein the dielectric comprises hollow structures and is in particular produced as foamed polyethylene material. By means of the foaming, the polyethylene material is not only made homogenous but in particular also isotropic, i.e. the macro molecules which are contained in the polyethylene foam do not show a preferential direction but only an orientation by coincidence and do not necessarily have to be stretched, i.e. oriented along any direction.

In view of this prior art, it is the object of the present invention to further improve the homogeneity and symmetry of the dielectric of the above-defined antenna structure.

According to the invention the present object is attained by an antenna structure having the features set out in the opening part of this specification, wherein the dielectric carrier material includes a homogeneous plastic layer which contains macromolecules and which is distinguished by an orientation of the macromolecules along a preferential direction, wherein the preferential direction is the longitudinal direction of the stripline.

For signal transmission at high data rates with a low level of electromagnetic radiation and high interference immunity in relation to electromagnetic radiations it is necessary for the dielectric carrier material to be of very high homogeneity.

If, as proposed according to the invention, a plastic layer containing macromolecules is used, the homogeneity of the dielectric carrier material can be improved by orientation of the macromolecules in a preferential direction. The orientation of the macromolecules means that an unequal charge distribution in the material and an unwanted displacement of the energy levels of the chemical bond energies which are to be attributed to an interaction between the macromolecules are improbable. That means that the electrical and magnetic fields in the material are overall more homogeneous.

It has proven to be particularly advantageous if the macromolecules contained in the plastic layer are oriented along the longitudinal direction of the stripline. The orientation of the macromolecules in the dielectric carrier material can be achieved by a stretching process in which the dielectric carrier material is stretched by the application of a tensile stress in the desired preferential direction. Due to the deformation of the carrier material the secondary polymers and the part-crystalline regions of the plastic layer are oriented approximately parallel to the tensile direction. By virtue of that measure the contact surfaces between the macromolecules become larger, the spacing smaller and the structure more homogeneous. In addition the secondary bondings become stronger.

In addition the mechanical strength of the dielectric carrier material in the tensile direction can be increased by the stretching process. Particularly in the case of long striplines the orientation of the macromolecules along the longitudinal direction of the stripline can be observed to give an improved in mechanical strength and thus a reduced risk of breakage of the stripline. By virtue of increasing the mechanical strength and the reduced breakage risk such antenna structures are suitable in particular for wide-band transmission of electrical signals, in which striplines and/or probes move in a circulating movement on a circular path as is the case for example in rotational transmission systems for computer tomographs.

It will be appreciated that in accordance with the present invention the orientation of the macromolecules along a preferential direction is satisfied if a predominant number of the macromolecules present are oriented along the selected preferential direction. Equally it will be appreciated that transmission of the signals can be operated on both sides, that is to say the stripline as the transmitter and the probe as the receiver or however also the stripline as the receiver and the probe as the transmitter. Bidirectional signal transmission is also conceivable. Accordingly in accordance with the invention the probe can also be designed as a stripline or as a short portion thereof.

The stripline is mostly open towards one side to the free space. The probe is coupled from that side. The probe and optionally also the casing thereof are closed off by surfaces which are as symmetrical as possible, with a conducting surface. In that way it is possible on the one hand to achieve a defined impedance for the conductor line system and on the other hand to implement a definedly symmetrical delimitation. If no defined reference surface were present then at least a part of the apparatus in which the antenna structure is disposed would be operative as an electrical reference, whereby the required symmetry would not be achieved.

A further embodiment provides that the dielectric carrier material has at least one further homogeneous dielectric layer. By virtue of the further homogeneous dielectric layer, materials with different electrical properties can be combined in such a way that the dielectric carrier material is suitable in its entirety for producing homogeneous fields. In addition the mechanical properties of the further dielectric layer and the plastic layer can differ so that the dielectric carrier material in its entirety can also be designed in accordance with correspondingly mechanical points of view.

A further embodiment of the invention provides that the changes in the permittivity value $\in_r$ of the dielectric carrier material and/or the changes in the permittivity value $\in_r$ of the further dielectric layer in any direction in space are less than 5%, preferably less than 1% and particularly preferably less than 0.1%. If the changes in the permittivity value $\in_r$ are less than the above-mentioned limit values the respective dielectric layer is particularly homogeneous so that the dielectric losses are subject to only extremely slight fluctuations.

To improve the mechanical properties a further embodiment provides that the dielectric carrier material has at least one mechanical reinforcing layer. For example a glass fiber-reinforced plastic layer can be incorporated to or joined to the dielectric carrier material. It has also been found that a stripline with a dielectric carrier material which has a mechanical reinforcing layer can be particularly well mechanically shaped or post-treated so that the stripline is particularly well adapted for being fitted in an electrical apparatus.

In a further embodiment the carrier material has at least one equipotential surface. Equipotential surfaces help to compensate for asymmetries in the dielectric carrier material so that the electrical and/or magnetic field produced is very substantially symmetrical. To provide such equipotential layers, layers of conductive material, in particular material with a high conductivity, can be let into the dielectric carrier material. In particular a layer of conductive material with an incomplete surface coverage, like for example a metal grid, could be introduced into the plastic layer directly in manufacture of the dielectric carrier material, which in operation as an equipotential surface filters out asymmetries or disturbances in the electrical and/or magnetic fields produced. Depending on the respective configuration involved those layers can be introduced in electrically insulated relationship or can also be closed off in reflection-free fashion at the ends of the stripline.

If the stripline is of mirror symmetry in cross-section, as is provided in an embodiment, the extent of the electrical and magnetic fields produced can be particularly well limited. Here and hereinafter symmetry is to be understood in relation to the longitudinal central plane of the stripline. The provision of symmetrical striplines prevents non-homogeneities and/or asymmetries being produced due to different transit times in the strip electrode, the reference electrode and/or the dielectric carrier material.

In a further embodiment the smallest spacing between stripline and probe measured from the surface of the strip electrode, that is towards the probe, to the surface of the probe, that is towards the stripline, is less than 15 mm, preferably less than 8 mm and is particularly preferably in the range of between 1 mm and 4 mm.

A further embodiment provides that the at least one strip electrode and the reference electrode are respectively printed on to a plastic film. It has been found that the manufacture of a stripline can be implemented in particularly inexpensive fashion if the strip electrode and the reference electrode are respectively printed on to a plastic film and they are then arranged at or on the dielectric carrier material. Particularly preferably the strip electrode and the reference electrode are made from copper which is applied by printing to a respective plastic film. The plastic film itself can in that case be the dielectric carrier material, in an embodiment.

In an embodiment the stripline has two strip electrodes arranged in the same plane in parallel and mutually spaced relationship. Such symmetrical striplines can be of a particularly low-radiation nature, wherein in particular it is possible to compensate for interference phenomena by the use of symmetrical or asymmetrical electrical signals, on two parallel strips. In accordance with the present invention the term 'parallel' is also intended to embrace such arrangements in which the strip electrodes are admittedly structured in themselves, but as a whole they extend substantially parallel to each other.

In a further embodiment there is provided an electronic transmitting means which is so adapted that between the first strip electrode and the reference electrode and between the second strip electrode and the reference electrode it applies signals which are of opposite polarity. The involvement of signals of opposite polarities permits differential transmission in which selective interferences, in particular asymmetries and non-homogeneities, can be compensated. Such symmetrical antenna structures are also particularly low in radiation as the electrical and magnetic fields cancel each other out in the far region.

Figure 2:
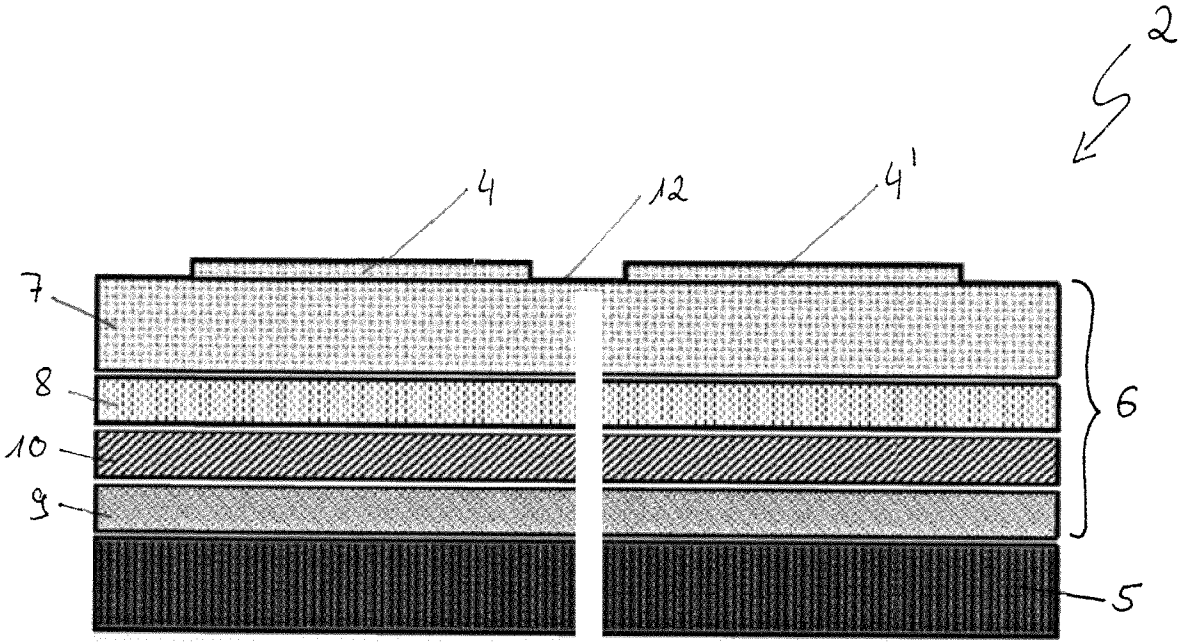

Further advantages, features and possible uses of the present invention will be apparent from the description hereinafter of preferred embodiments and the related Figures in which:

FIG. 1 shows a partly broken-away perspective view of an antenna structure according to the invention, and FIG. 2 shows a diagrammatic cross-section through a stripline according to an embodiment of the present invention.

FIG. 1 shows a partly broken-away perspective view of an antenna structure 1 according to the invention. For the wide-band transmission of electrical signals the antenna structure 1 has a stripline 2 and a probe 3 which are arranged movably relative to each other within a predetermined spacing range in the longitudinal direction of the stripline 2. The stripline 2 is of a greater longitudinal extent than the probe 3. Signal transmission between stripline 2 and probe 3 can take place during the relative movement.

The stripline 2 has two strip electrodes 4, 4' facing towards the probe 3, a reference electrode 5 and a dielectric carrier material 6 between the strip electrodes 4, 4' and the reference electrode 5. In this case the strip electrodes 4, 4' and the reference electrode 5 are arranged parallel to each other on opposite sides of the dielectric carrier material 6.

When in operation of the antenna structure 1 a voltage signal provided by an electronic transmitting means 11 is applied between the strip electrodes 4, 4' and the reference electrode 5 electrical and magnetic fields are produced by charge displacements in the dielectric carrier material 6. By virtue of the arrangement of the strip electrodes 4, 4', the reference electrode 5 and the dielectric carrier material 6 field lines of the fields produced extend substantially perpendicularly to the longitudinal direction of the stripline 2.

To reduce the influence of extraneous fields, asymmetries and/or non-homogeneities the voltage signals between the first strip electrode 4 and the reference electrode 5 and between the second strip electrode 4' and the reference electrode 5 are of opposite polarities but in other respects involve an identical signal configuration. In that respect it is advantageous for the dielectric carrier material 6 to include a plastic layer containing macromolecules, wherein the predominant number of the macromolecules contained in the plastic layer are oriented in the longitudinal direction of the stripline 2. The orientation of the micromolecules provides that the dielectric carrier material 6 which here is made solely from the plastic layer 7 has the required homogeneity to permit wide-band transmission of electrical signals with electrical or magnetic fields which are spatially limitedly operative.

The fields produced can be transmitted to the probe 3 by capacitive or inductive coupling, wherein the stripline 2 and the probe 3 are at a minimal spacing relative to each other which, measured from the surface of the strip electrode 4 facing towards the probe to the surface of the probe 3 facing towards the stripline 2 is less than 15 mm.

In this embodiment the probe 3 is structured like the stripline 2 so that the antenna structure 2 is suitable for bidirectional transmission of signals between stripline 2 and probe 3.

FIG. 2 shows a diagrammatic cross-section through a stripline 2 according to the present invention. The stripline 2 has two parallel strip electrodes 4, 4' which comprise copper and which are printed on to a plastic film 12. Beneath the strip electrodes 4, 4' the plastic film 12 is connected to a dielectric carrier material 6 made up of a plurality of layers. A first layer is a homogeneous plastic layer 7 which contains macromolecules and which is distinguished by an orientation of the macromolecules along the longitudinal direction of the stripline 2. The permittivity value $\in_r$ of the homogeneous plastic layer 7 changes in any direction in space by less than 5%.

Arranged beneath the homogeneous plastic layer 7 are a further homogeneous dielectric material layer 8 and a mechanical reinforcing layer 9. Embedded between the further dielectric material layer 8 and the mechanical reinforcing layer 9 is a metal grid which in operation constitutes an equipotential surface 10. The homogeneous plastic layer 7, the further dielectric material layer 8, the metal grid as the equipotential surface 10 and the mechanical reinforcing layer 8 together form the dielectric carrier material 6. As can be seen in the cross-sectional view the stripline 2 is of a symmetrical configuration in cross-section.

For the purposes of the original disclosure it is pointed out that all features as can be seen by a man skilled in the art from the present description, the drawings and the appended claims, even if they are described in specific terms only in connection with certain other features, can be combined both individually and also in any combinations with others of the features or groups of features disclosed here insofar as that has not been expressly excluded or technical aspects make such combinations impossible or meaningless. A comprehensive explicit representation of all conceivable combinations of features and emphasis of the independence of the individual features from each other is dispensed with here only for the sake of brevity and readability of the description.

LIST OF REFERENCES

1 antenna structure
2 stripline
3 probe
4, 4' strip electrode
5 reference electrode
6 dielectric carrier material
7 homogeneous plastic layer
8 homogeneous dielectric layer
9 mechanical reinforcing layer
10 equipotential surface
11 electronic transmitting means

The invention claimed is:

1. An antenna structure (1) for the wide-band transmission of electrical signals, which has a stripline (2) and a probe (3) which can be capacitively or inductively coupled to the stripline, wherein the stripline (2) and the probe (3) are arranged movably relative to each other in the longitudinal direction of the stripline (2) within a predetermined spacing range between the probe (3) and the stripline (2) so that electrical signals can be contact-lessly transmitted between the stripline (2) and the probe (3), wherein the stripline (2) includes at least one strip electrode (4) facing the probe (3) and a reference electrode (5) and a dielectric carrier material (6) between the strip electrode (4) and the reference electrode (5), characterised in that the dielectric carrier material (6) includes a homogeneous plastic layer (7) which contains macromolecules and which is distinguished by an orientation of the macromolecules along a preferential direction of the stripline.

2. An antenna structure (1) as set forth in claim 1 characterised in that the dielectric carrier material (6) has at least one further homogeneous dielectric layer (8).

3. An antenna structure (1) as set forth in claim 1 characterised in that the changes in the permittivity value $\in_r$ of the dielectric carrier material (6) and the changes in the permittivity value $\in_r$ of the further dielectric layer (8) in any direction in space are less than 5%, preferably less than 1% and particularly preferably less than 0.1%.

4. An antenna structure (1) as set forth in claim 1 characterised in that the dielectric carrier material (6) has at least one mechanical reinforcing layer (9).

5. An antenna structure (1) as set forth in claim 1 characterised in that the carrier material (6) has at least one equipotential surface (10).

6. An antenna structure (1) as set forth in claim 5 characterised in that the carrier material has a layer of conductive material with an incomplete surface coverage, said layer acting in operation as the equipotential surface (10).

7. An antenna structure (1) as set forth in claim 5 characterised in that the carrier material has a metal grid layer of conductive material with an incomplete surface coverage, said layer acting in operation as the equipotential surface (10).

8. An antenna structure as set forth in claim 1 characterised in that the stripline (2) is of a symmetrical configuration in cross-section.

9. An antenna structure (1) as set forth in claim 1 characterised in that the smallest spacing between stripline (2) and probe (3) measured from the surface of the strip electrode (4), that is towards the probe (3), to the surface of the probe (3), that is towards the stripline (2), is less than 15 mm.

10. An antenna structure (1) as set forth in claim 9 characterised in that the smallest spacing between stripline (2) and probe (3) measured from the surface of the strip electrode (4), that is towards the probe (3), to the surface of the probe (3), that is towards the stripline (2), is less than 8 mm.

11. An antenna structure (1) as set forth in claim 10 characterised in that the smallest spacing between stripline (2) and probe (3) measured from the surface of the strip electrode (4), that is towards the probe (3), to the surface of the probe (3), that is towards the stripline (2), is in the range of between 1 mm and 4 mm.

12. An antenna structure (1) as set forth claim 1 characterised in that the at least one strip electrode (4) and the reference electrode (5) are respectively printed on to a plastic film (12).

13. An antenna structure as set forth in claim 1 characterised in that the stripline (2) has two strip electrodes (4, 4') which are arranged in the same plane in parallel and mutually spaced relationship.

14. An antenna structure (1) as set forth in claim 1 characterised in that there is provided an electronic transmitting means (11) which is so adapted that between the first strip electrode (4) and the reference electrode (5) and between the second strip electrode (4') and the reference electrode (5) it applies signals which have an identical signal configuration but are of opposite polarity.

15. An antenna structure (1) as set forth in claim 1 characterised in that the changes in the permittivity value $\in_r$ of the dielectric carrier material (6) in any direction in space are less than 5%, preferably less than 1% and particularly preferably less than 0.1%.

16. An antenna structure (1) as set forth in claim 1 characterised in that the changes in the permittivity value $\in_r$ of the further dielectric layer (8) in any direction in space are less than 5%, preferably less than 1% and particularly preferably less than 0.1%.

* * * * *